US006772796B2

(12) United States Patent
Debaes et al.

(10) Patent No.: US 6,772,796 B2
(45) Date of Patent: Aug. 10, 2004

(54) DEVICE FOR ATTACHING TEMPLES ON A FACE-TO-FACE WEAVING MACHINE

(75) Inventors: Johnny Debaes, Moorslede (BE); Ferdi Dejaegere, Dadizele (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 164 days.

(21) Appl. No.: 10/126,959

(22) Filed: Apr. 22, 2002

(65) Prior Publication Data

US 2002/0170614 A1 Nov. 21, 2002

(30) Foreign Application Priority Data

Apr. 20, 2001 (BE) ..... 2001/0275

(51) Int. Cl.[7] ..... D03J 1/22
(52) U.S. Cl. ..... 139/301; 139/296; 139/298
(58) Field of Search ..... 139/292, 294, 139/295, 296, 297, 298, 299, 300, 301

(56) References Cited

U.S. PATENT DOCUMENTS 422,248 A * 2/1890 Piper ..... 139/298
2,239,191 A * 4/1941 Chard ..... 139/295
2,434,820 A * 1/1948 Tifft ..... 139/296
2,972,361 A * 2/1961 Pfarrwaller ..... 139/297
3,455,343 A * 7/1969 Golobart ..... 139/294
3,525,371 A * 8/1970 Hux ..... 139/294

FOREIGN PATENT DOCUMENTS

DE 1535835 5/1970
DE 9312450 10/1993

* cited by examiner

*Primary Examiner*—Danny Worrell
(74) *Attorney, Agent, or Firm*—James Creighton Wray; Meera P. Narasimhan

(57) ABSTRACT

The invention relates to a device for attaching to a face-to-face weaving machine cylindrical upper and lower temples of the type having inclined toothed rings provided on shanks, the shanks of the upper and lower temples being attached to separate L-shaped upper and lower temple holder plates, in such a manner the temple shanks, pointing to the center of the weaving machines, are attached to the leg of the L-shaped holder plate placed in the warp direction, whereas the other leg of the L-shaped holder is directed towards the outside of the weaving machine and, in a manner adjustable in the warp-direction, is attached to a horizontal connecting piece, itself, in a manner adjustable as to height, being attached to a vertical holder.

11 Claims, 2 Drawing Sheets

DEVICE FOR ATTACHING TEMPLES ON A FACE-TO-FACE WEAVING MACHINE

This application claims the benefit of Belgian Application No. 2001/0275 filed Apr. 20, 2001.

The invention relates to attaching en adjusting "temples" on face-to-face weaving machines.

Temples are tools for tightening fabrics evenly and to avoid that the warp will get shorter during weaving, usually provided with metal pins pricking into the selvedge of the fabric. Especially known, for instance, from the documents DIN ISO 8118 and DE GM 9312450 (the contents of which are considered to be incorporated in this document by referring to them) are so-called cylindrical temples provided with a number of rings carrying pins.

On a face-to-face weaving machine, a similar temple device is provided on both sides of the fabric to keep the fabric at the same width as when the weaving reed is heddled. Because of this the warp threads are prevented from rubbing against the weaving reed dents, on both sides of the fabric, caused by shrinkage of the fabric and which may cause breakages of the warp threads.

As already mentioned the cylindrical temples are provided with a number of rings, carrying pins. These rings are rotatably attached next to one another on an inclined toothed ring. These toothed rings together are slid on a cylindrical bolt with a shank and fixed. A temple device consists of two to three cylinders attached behind one another in the warp direction to a temple holder plate. On each side of the fabric, a similar set of cylinders is provided on a common temple holder plate for the upper cloth and another for the lower cloth. A temple fingerplate is brought between the upper and lower cloth in order to press the fabric selvedges with a certain angle of contact over the cylindrical rings with pins. The pins will pierce the fabric edges and the fabric is pulled at its width by the inclined sense of rotation of the pinned rings. Only after having passed the temple zone the fabric may start to shrink in the weft direction.

According to the known state of the art, the cylindrical temples are attached to the common temple holder plate by means of a shank, a certain thickness of the plate being required in order to absorb the tractive force of the fabric.

Then auxiliary or weft tucking ribbons are provided along the fabric selvedges, woven with warp threads moved partly by the edge weaving frames and partly by the twister device in order to form a face-to-face shed. The tucking ribbons are cut by means of an edge-cutting device and removed to a receiving device. Weft ends on the fabric selvedges that are too long will be inconvenient during the finishing process the fabric has to pass after weaving. Cutting and removal of the auxiliary tucking ribbons means a certain loss of material. When the loss of weft and warp threads should be eliminated on the supply gripper side or on the weft yarn insertion side of the weaving machine by omitting those weft tucking ribbons or auxiliary edges, then the weft ends remaining on the fabric will still be much too long, because it will be impossible to install the weft cutter close enough to the fell of the fabric edge, because the temple holder plate must have a certain thickness to absorb the tractive force of the fabric.

The temple holders according to the state of the art are attached to the lower or upper ruler. The upper and lower ruler determine the bite between which the fabric is cut in the upper and lower cloth. A small correction of the pile height also requires a correction of the adjustment of the bite. Now when the temples are attached to the rulers, this requires the temple holders also to be adjusted. Therefore, adjusting the pile height is a rather laborious job.

SUMMARY OF THE INVENTION

It is the purpose of this invention to provide a device for attaching the temples in a face-to-face weaving machine which will be able to weave without auxiliary edges or tucking ribbons and where the weft cutter can be installed very close to the fabric selvedge, so that the weft ends remaining at the fabric selvedge can be cut short. By omitting the auxiliary edges or tucking ribbons, a considerable economy on weft and warp thread material may be realized and a cutting device for cutting the auxiliary edges is no longer needed on the weaving machine.

A second purpose is to render temple adjusting independent of pile height adjustment.

The first purpose is efficiently attained by installing the thick temple holder plate above and below the fabric respectively more towards the interior or towards the center of the fabric and therefore away from the fabric selvedges, in such a manner that the shank of the cylindrical temples points to the interior or the center of the weaving machine and the top of the cylindrical temples towards the outside. At the top of the cylindrical temples a thin temple finger plate is attached, in such a manner that the fingers reach between the selvedges of the upper and the lower cloth in order to press the fabric over a certain contact angle around the rings with the pins.

With this construction, the face-to-face fabric is kept perfectly at width and the weft cutter can be installed very close to the fabric selvedge, because of which the ends remaining on the fabric selvedge are cut sufficiently short. In this manner, weaving with auxiliary or tucking ribbons on the supplier side or weft insertion side becomes unnecessary and an economy on weft and warp yarns can be obtained and also on a number of more expensive twister warp yarns. A device for cutting and collecting these auxiliary edges is no longer necessary.

In order to realize those purposes of the invention a device is provided for attaching to a face-to-face weaving machine cylindrical upper and lower temples of the type having inclined toothed rings provided on shanks, the shanks of the upper and lower temples being attached to separate L-shaped upper and lower temple holder plates in such a manner that the shank of the cylindrical temple, pointing to the center of the weaving machine, are attached to the one leg, placed in the warp direction, of an L-shaped holder, whereas the other leg of the L-shaped holder is directed towards the outside of the weaving machine and is attached to the weaving machine in a manner being adjustable in the warp direction and as to height.

By means of a thin temple finger plate, the temple holder plates according to this invention can be attached, in a suitable manner, to the top of the temple shanks on the outside of the weaving machines i.e. a temple finger plate the thickness of which is less than 3.5 mm, because of which the weft cutter can be installed closer to the fabric selvedge over the same distance.

Preferably, in that case, the L-shaped temple holder plate of the upper temple and the L-shaped temple holder plate of the lower temple, adjustable separately in the warp direction, are attached to a horizontal connecting piece that is attached to the weaving machine in a manner adjustable as to height.

At the same time, in a very suitable manner, the horizontal connecting piece can be attached, adjustable as to height, to a vertical holder that is connected to the weaving machine.

The attachment of the L-shaped temple holder plates to a horizontal connecting piece and the attachment of the horizontal connecting piece to the vertical holder preferably consists of a tooth and slot connection. Preferably, at the bottom, the vertical holder is attached to a traverse, more specifically the front traverse, of the weaving machine by means of a T-slot connection.

According to an embodiment of the invention on a weaving machine with weft cutter and weft presenting drive, preferably all of the temple holder plate attachments are connected, by means of an adjusting screw spindle, to a casing to which the weft cutter and the weft presenting drive are likewise connected.

All of the temple holder plate attachments comprising especially the temple holder plates, the horizontal connecting pieces and the vertical holder.

Moreover, a tie rod can be provided very suitably also, which by means of a (further) adjusting screw spindle is connected to a second support on the front traverse of the weaving machine, with which all of the temple support and the weft presenting can be moved.

Preferably, that adjusting screw spindle is provided with a right hand and a left hand thread.

The characteristics and the particularities of the invention and its functioning are further explained hereafter referring to the attached drawings representing a preferred embodiment of the invention. It will be noted that the specific aspects of that embodiment are described only as a preferred example of what is meant in the scope of the above-mentioned general description of the invention and may in no way be interpreted as a restriction of the scope of the invention as such and as expressed in the claims following hereafter.

DETAILED DESCRIPTION OF THE PREFERRED EMBODIMENTS

Figure 1:
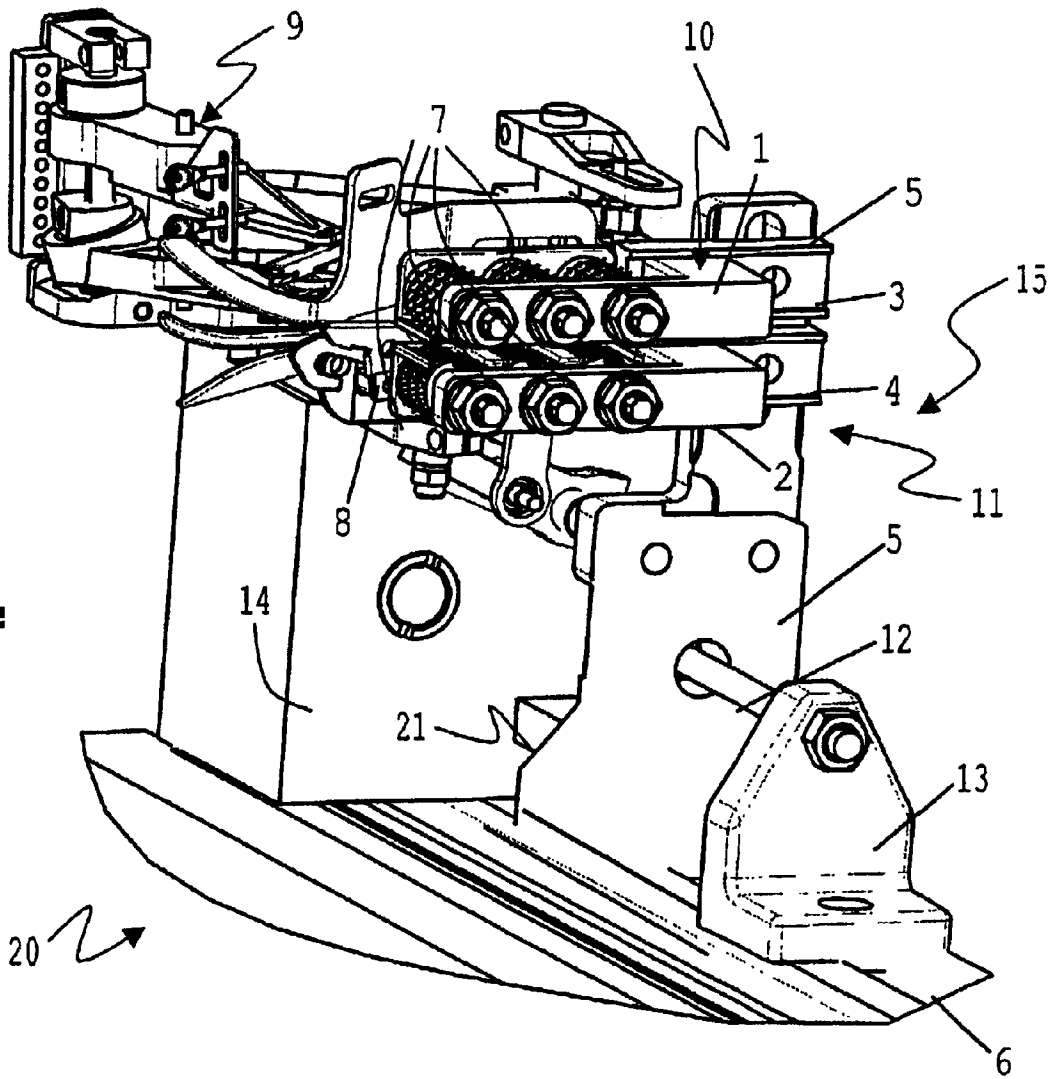
FIG. 1 is a perspective side view of a temple device according to the invention.
Figure 2:
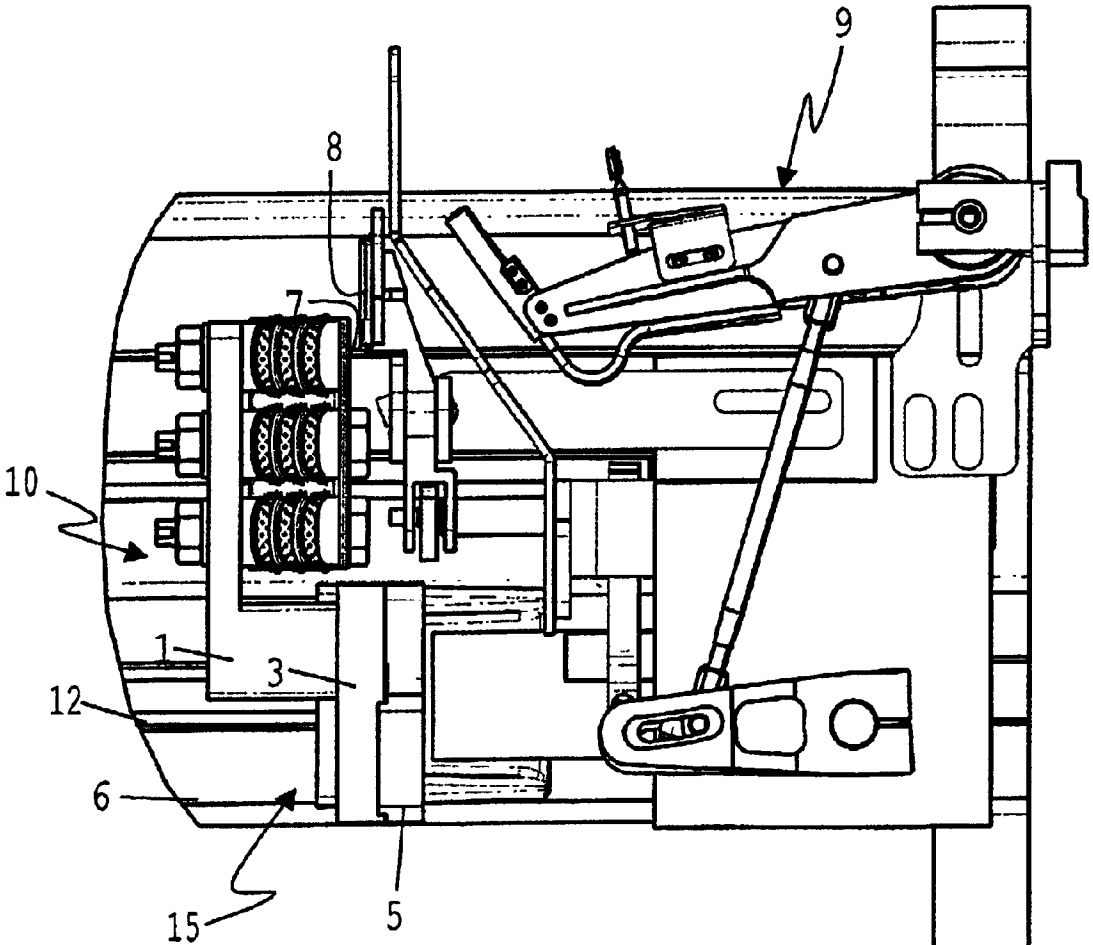
FIG. 2 is a top view of the device according to figure

In FIG. 1 is represented a top view of the L-shaped temple holder plate (1) and (2) of both upper and lower temple. The upper temple holder plate (1) and the lower temple holder plate (2) are each separately attached, along the fabric selvedge, to a connecting piece (3) and (4) extending horizontally by means of a tooth and slot connection. Because of this, the temples are perfectly adjustable in the warp direction. Each horizontal connecting piece (3), (4) is likewise attached to a vertical holder (5), adjustable as to height, by means of a tooth and slot connection, which at the bottom is attached to the front traverse of the weaving machine by means of a T and slot connection. Therefore, each temple holder (10), (11) is perfectly adjustable as to height.

The temple holders are no longer attached to the upper or lower ruler, as in the state of the art. Therefore, a small correction of the pile height does not require any modification of the adjustment of he temple device.

When weaving a fabric or in case of a fabric change the temple devices (15) must be removed outwards away from each step by step in order to gradually pull the fabric to width until the heddling width in the weaving reed is attained. To facilitate this adjustment and to avoid that the temple finger plate (7) might hurt the weft cutter (8), the temple holder device, preferably provided with an adjusting screw spindle provided with a right hand and a left hand thread, or a fixed connection (21), is connected to the casing (14) of the weft cutter (8) and if available to a weft presenting device drive (9). In this manner temple (15) and weft presenting (9) may be adjusted in one operation, the mutual distance being exactly maintained and avoiding any damaging of the weft cutters (8) because of possible faulty adjustments. By means of a tie rod (12) connected to a second support (13) on the front traverse (6) of the weaving machine (20), the entity temple support—weft presenting (30) may be moved by means of an adjusting screw spindle against the traction of the fabric. Therefore adjusting also becomes much less time-consuming.

What is claimed is:

1. Device for attaching cylindrical upper and lower temples to a face-to-face weaving machine, the temples comprising inclined toothed rings provided on shanks of the upper and lower temples, wherein the shanks of the upper and lower temples are connected to separate L-shaped upper and lower temple holder plates such that the shanks of the cylindrical temples pointing to a center of the weaving machine are attached to one leg of the L-shaped holder plate placed in a warp direction, whereas another leg of the L-shaped holder plate is directed towards an outside of the weaving machine, is adjustably connected to the weaving machine and is adjustable in the warp direction and adjustable as to height.

2. Device according to claim 1, further comprising a temple finger plate having a thickness less than 3.5 mm attached to tops of the temple shanks on the outside of the weaving machine.

3. Device according to claim 1, wherein the L-shaped temple holder plate of the upper temple and the L-shaped temple holder plate of the lower temple are separately adjustable in the warp direction, and are connected by one attachment to a horizontal connecting piece which is adjustably connected to the weaving machine and is adjustable as to height.

4. Device according to claim 3, wherein the horizontal connecting piece is adjustably attached by another attachment to a vertical holder connected to the weaving machine.

5. Device according to claim 4, wherein the one attachment of the L-shaped temple holder plates to the horizontal connecting piece and the another attachment of the horizontal connecting piece to the vertical holder are tooth and slot connections.

6. Device according to claim 5, wherein a bottom of the vertical holder is attached to a traverse of the weaving machine by a tooth and slot connection.

7. Device according to claim 6, wherein the traverse is a front traverse and wherein the vertical holder is attached to the front traverse of the weaving machine.

8. Device according to claim 7, for a weaving machine with a weft cutter and a weft presenting drive, wherein all of the temple holder plate attachments are connected by an adjusting screw spindle to a casing to which the weft cutter and the weft presenting drive are likewise connected.

9. Device according to claim 8, wherein all of the temple holder plate attachments comprise the horizontal connecting pieces and the vertical holder.

10. Device according to claim 8, further comprising a tie rod and an adjusting screw spindle connecting the tie rod to a support on the front traverse of the weaving machine thereby moving all of the temple holder plate attachments and the weft presenting drive.

11. Device according to claim 8, wherein the adjusting screw spindle is provided with right hand and left hand threads.

* * * * *